US008277343B2

(12) United States Patent
Chang

(10) Patent No.: US 8,277,343 B2
(45) Date of Patent: Oct. 2, 2012

(54) BAT CONSTRUCTED FOR STRIKING A BALL

(76) Inventor: Jung-Shih Chang, Taichung Hsien (TW)

( * ) Notice: Subject to any disclaimer, the term of this patent is extended or adjusted under 35 U.S.C. 154(b) by 138 days.

(21) Appl. No.: 12/788,727

(22) Filed: May 27, 2010

(65) Prior Publication Data

US 2011/0237366 A1 Sep. 29, 2011

(30) Foreign Application Priority Data

Mar. 23, 2010 (CN) ..... 2010 2 0158763 U

(51) Int. Cl.
*A63B 59/06* (2006.01)

(52) U.S. Cl. ..... 473/566; 473/567

(58) Field of Classification Search ..... 473/457, 473/519, 520, 564–568
See application file for complete search history.

(56) References Cited

U.S. PATENT DOCUMENTS

| | | | | | |
|---|---|---|---|---|---|
| 377,686 | A * | 2/1888 | Moose | 473/564 |
| 1,063,563 | A * | 6/1913 | May | 473/564 |
| 1,603,904 | A * | 10/1926 | Cohn | 473/519 |
| 1,665,195 | A * | 4/1928 | Cohn | 473/520 |
| 2,379,006 | A * | 6/1945 | Johnson | 473/568 |
| 3,377,066 | A * | 4/1968 | Trowbridge | 473/564 |
| 3,877,698 | A * | 4/1975 | Volpe | 473/520 |
| 4,056,267 | A * | 11/1977 | Krieger | 473/520 |
| 6,609,984 | B1 * | 8/2003 | Tribble | 473/564 |
| 6,824,482 | B1 * | 11/2004 | Tribble | 473/564 |
| 6,929,573 | B1 | 8/2005 | Chang | |
| 2005/0059515 | A1 * | 3/2005 | Chang | 473/564 |
| 2005/0070383 | A1 * | 3/2005 | Chang | 473/566 |
| 2005/0277497 | A1 * | 12/2005 | Chang | 473/567 |
| 2007/0232422 | A1 * | 10/2007 | Chang | 473/564 |
| 2010/0292035 | A1 * | 11/2010 | Huang | 473/564 |

* cited by examiner

*Primary Examiner* — Mark Graham
(74) *Attorney, Agent, or Firm* — Browdy and Neimark, PLLC

(57) ABSTRACT

A hybrid material bat comprises an elongate shaft, a reinforcing member, a barrel body and a grip body. The shaft is made of rigid materials and includes a front portion, an intermediate portion and a rear portion. The barrel body is made of materials with good striking performance and includes a striking section for striking, impacting, or hitting and a mid-section. The grip body is made of resilient materials with good shock absorbing property, and has a front end and a terminal end. The reinforcing member is made of rigid materials and disposed on a distal end of said front portion of said shaft. The barrel body intimately surrounds the front portion of the shaft and the reinforcing member. The grip body intimately surrounds the rear portion of the shaft.

3 Claims, 5 Drawing Sheets

BAT CONSTRUCTED FOR STRIKING A BALL

BACKGROUND OF THE INVENTION

1. Field of the Invention

The present invention relates generally to bats for striking a ball and in particular to hybrid material baseball bats.

2. Description of the Related Art

Wooden bats are most popularly used because they are the cheapest ones. However, wooden bats have numerous drawbacks, such as heavy weight and bad equilibrium. Furthermore, a wooden bat is weak and easy to break, and produces severe shocks when hitting the ball. Also, as wooden bats lose moisture and dry out, they lose strength and breakage increases.

More recently, beginning in the mid 1970's, aluminum baseball bats captured a large majority of the market share versus wood bats. In comparison to wooden bats, aluminum bats are relatively lighter in weight, and have an ideal equilibrium. Therefore, the performance of aluminum bats is superior to conventional wooden bats, and aluminum bats are more durable than conventional wooden bats. Further, the price of aluminum bats is reasonable. However, aluminum bats produce shocks, noises and dents at barrel when hitting the ball.

Recently as well, beginning in the late 1980's, bats made of polymer composite materials, such as fiber reinforced plastic (FRP) materials, have been developed. The objective of FRP bats is to improve either bat performance and/or durability. However, the problem is that FRP bats are too expensive to get a popular use.

To improve the drawbacks of the prior art bats, a hybrid material baseball bat had been proposed in U.S. Pat. No. 6,929,573 to the inventor of the present invention. According to this prior proposal, the handle and barrel are separate structural components. Further speaking, the prior art hybrid material baseball bat has a bat body combined by a wooden barrel portion and a PU (polyurethane) handle portion and a FRP core embedded in the bat body. In practical use, the performance of the hybrid material baseball bat is undoubtedly better than that of the conventional baseball bats made of wooden, aluminum, or polymer composite materials. However, the inventor of the present invention found that upon striking a pitched ball, the barrel portion of the hybrid material baseball bat is responsively flexed or bowed along its entire length from the distal end to the top end thereof. Thus, the distal end of the barrel portion easily breaks due to stress concentration produced during the striking moment.

Thus, there is a need in the art for a hybrid material bat having enhanced reinforcement properties, but without the drawbacks of the bat disclosed in U.S. Pat. No. 6,929,573.

SUMMARY OF THE INVENTION

In one aspect of the present invention an improved hybrid material bat is provided. The bat comprises an elongate shaft, a reinforcing member, a barrel body and a grip body. The shaft is made of rigid materials, such as metal or fiber-reinforced composite material, and includes a front portion, an intermediate portion and a rear portion. The barrel body is made of materials with good striking performance, such as wooden materials, and includes a striking section for striking, impacting, or hitting and a mid-section. The grip body is made of resilient materials with good shock absorbing property, such as plastic foam materials, and has a front end and a terminal end. The reinforcing member is made of rigid materials, such as metal or fiber-reinforced composite material, and disposed on a distal end of said front portion of said shaft. The barrel body intimately surrounds the front portion of the shaft and the reinforcing member. The grip body intimately surrounds the rear portion of the shaft.

Desirably, the reinforcing member may be an independent device, such as a sleeve, tightly put around the distal end of the front portion of the shaft, or a raised section formed on the distal end of the front portion of the shaft.

In another aspect of the present invention, the front end of the grip body is extended to joint to a rear end of the mid section of the barrel body such that the intermediate portion of the shaft is also intimately surrounded by the grip body.

These and other aspects and advantages will become more apparent after careful consideration is given to the following detailed description of the preferred exemplary embodiments thereof.

DETAILED DESCRIPTION OF PREFERRED EMBODIMENTS

Figure 1:
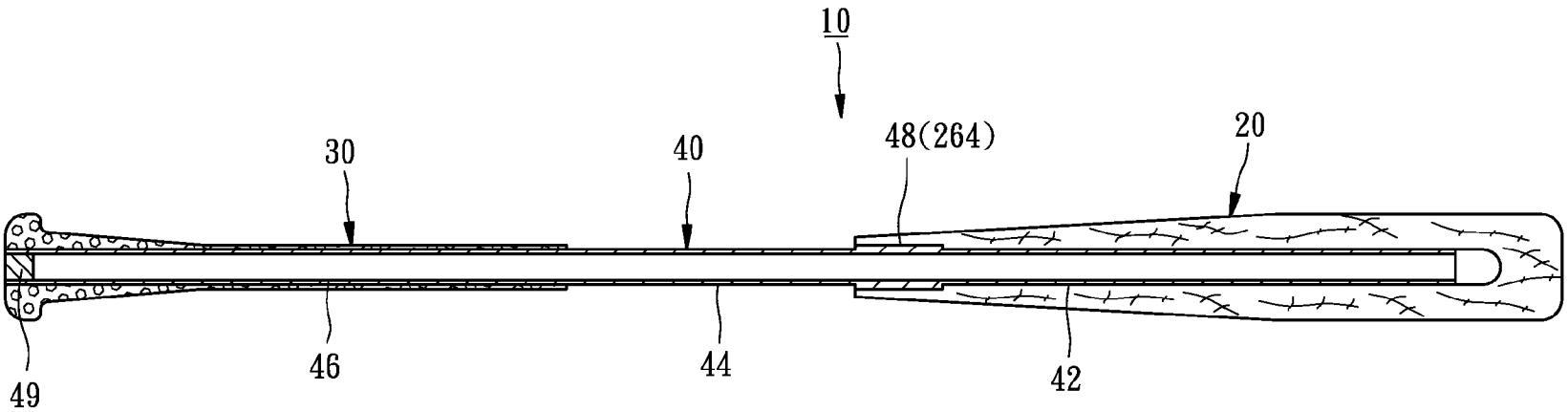
FIG. 1 is a longitudinal sectional view of a baseball bat constructed according to the first embodiment of the present invention.
Figure 2:
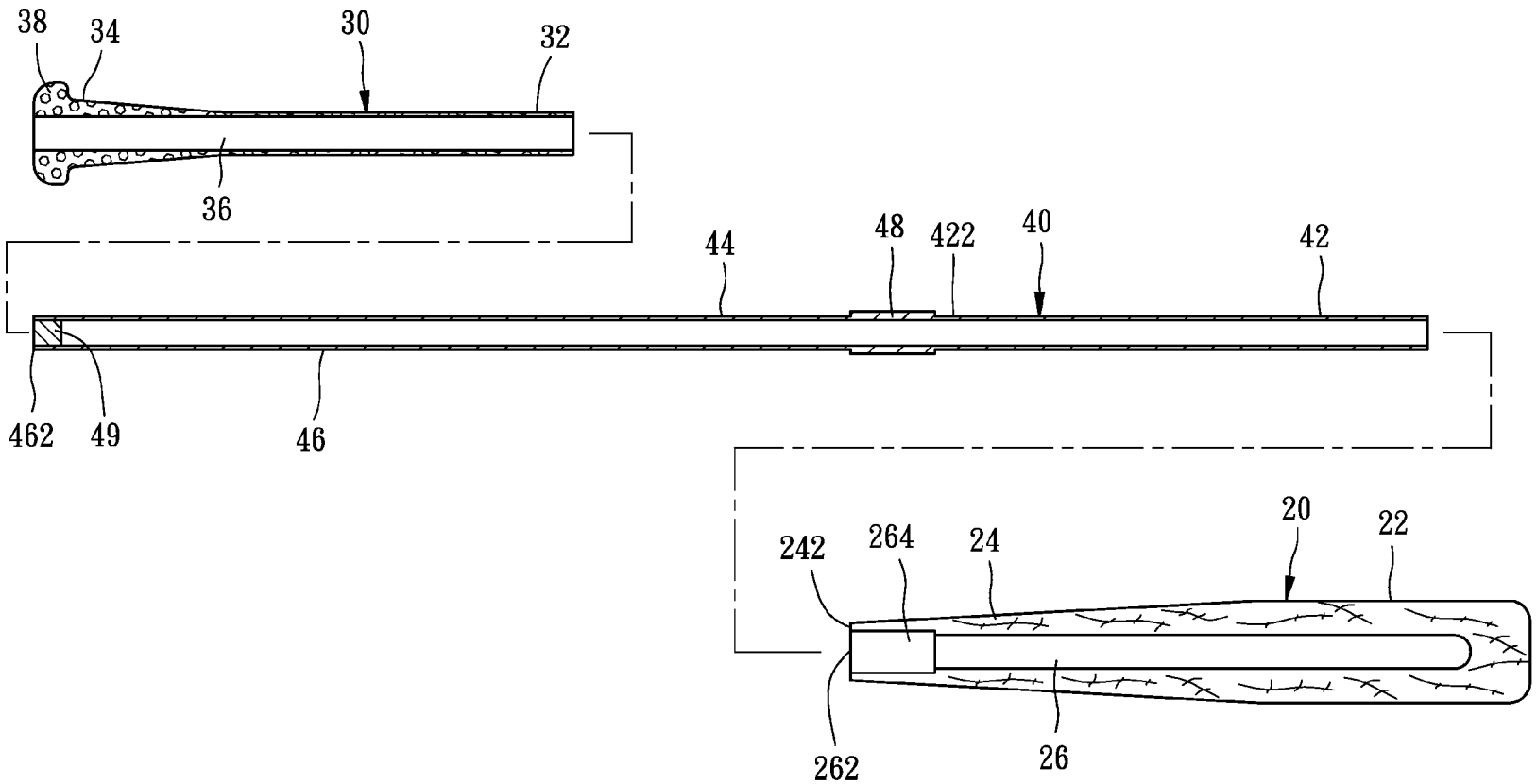
FIG. 2 is an exploded perspective view of the baseball bat depicted in FIG. 1.

Referring firstly to FIGS. 1 and 2, a baseball bat 10 of the first embodiment in accordance with the present invention includes a barrel body 20, a grip body 30 and an elongate shaft 40.

In this embodiment, barrel body 20 is made of wooden materials. Barrel body 20 has a striking section 22 for striking, impacting, or hitting, and a tapered mid-section 24. Barrel body 20 further has a front axial bore 26 with an entrance 262 formed on rear end 242 of tapered mid-section 24 and an enlarged part 264 adjacent to entrance 262.

Grip body 30, in this embodiment, is made of polyurethane. It includes a front end 32, a terminal end 34 and a rear axial bore 36. A knob 38 is formed on terminal end 34 of grip body 30.

Elongate shaft 40 is tube-shaped and made of fiber-reinforced composite material. Shaft 40 includes a front portion 42, an intermediate portion 44 and a rear portion 46. A raised section 48 is formed on distal end 422 of front portion 42 of shaft 40.

In combination, front portion 42 of shaft 40 inserts and extends into front axial bore 26 of barrel body 20 from entrance 262 in such a way that barrel body 20 intimately surrounds front portion 42 of shaft 40 and raised section 48 of shaft 40 is tightly received in enlarged part 264 of front axial bore 26 of barrel body 20. Rear portion 46 of shaft 40 inserts and extends into rear axial bore 36 of grip body 30 in such a way that grip body 30 intimately surrounds rear portion 46 of shaft 40. A barrel end plug 49 is plugged into distal end 462 of rear portion 46 of shaft 40.

Figure 3:
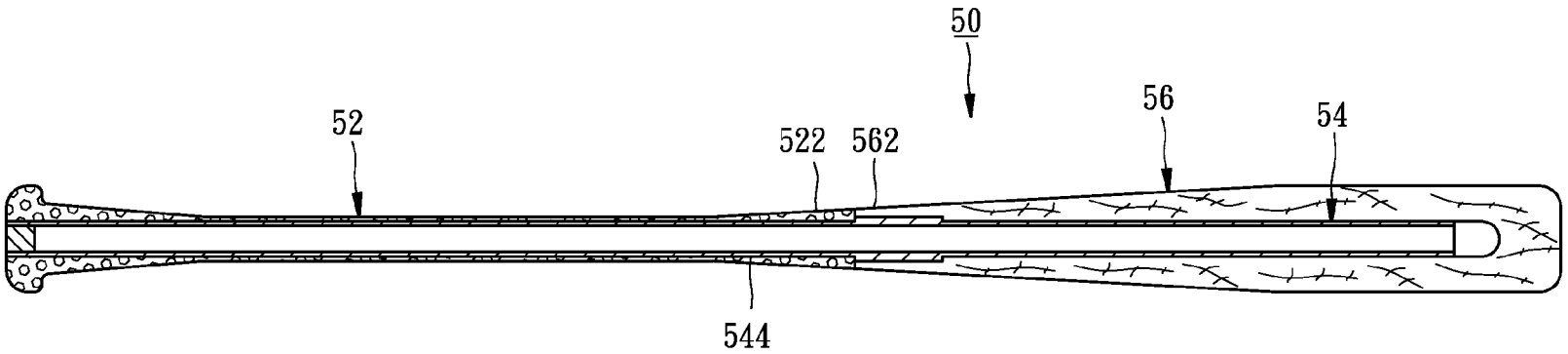
FIG. 3 is a longitudinal sectional view of a baseball bat constructed according to the second embodiment of the present invention.

Referring secondly to FIG. 3, it shows a baseball bat 50 constructed according to the second embodiment of the present invention. Bat 50 is similar to bat 10 of the first embodiment. The difference between bat 10 and bat 50 is that bat 50 has a grip body 52 having an extending front end 522 which intimately surrounds intermediate portion 544 of shaft 54 and joints to rear end 562 of barrel body 56.

Figure 4:
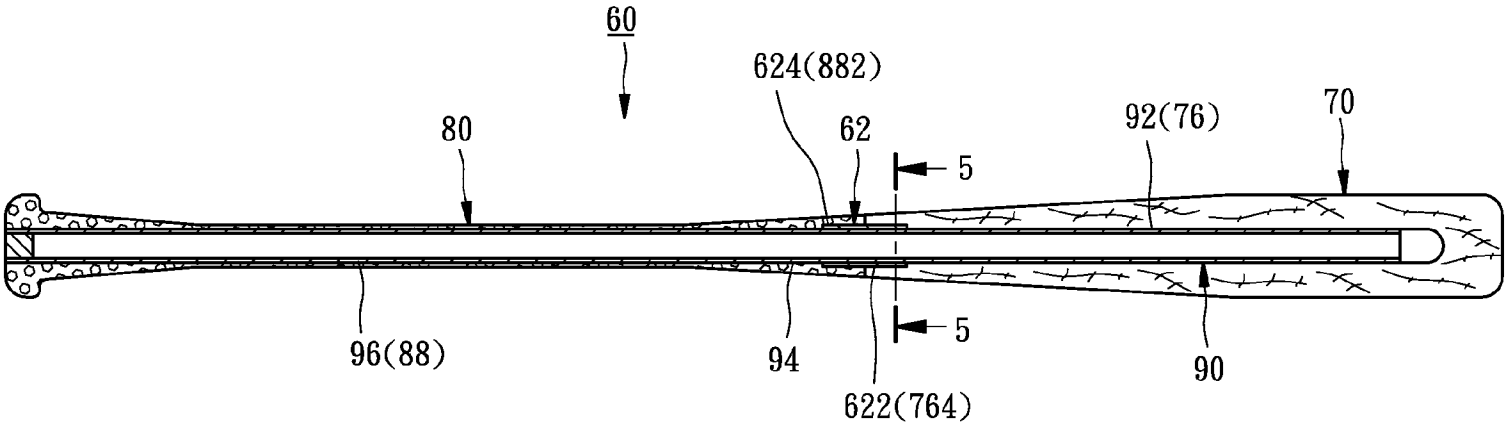
FIG. 4 is a longitudinal sectional view of a baseball bat constructed according to the third embodiment of the present invention.
Figure 5:
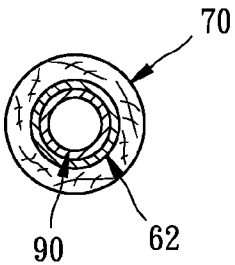
FIG. 5 is a perspective cross-sectional view of the ball bat depicted in FIG. 4 as taken along line 5-5 therein.
Figure 6:
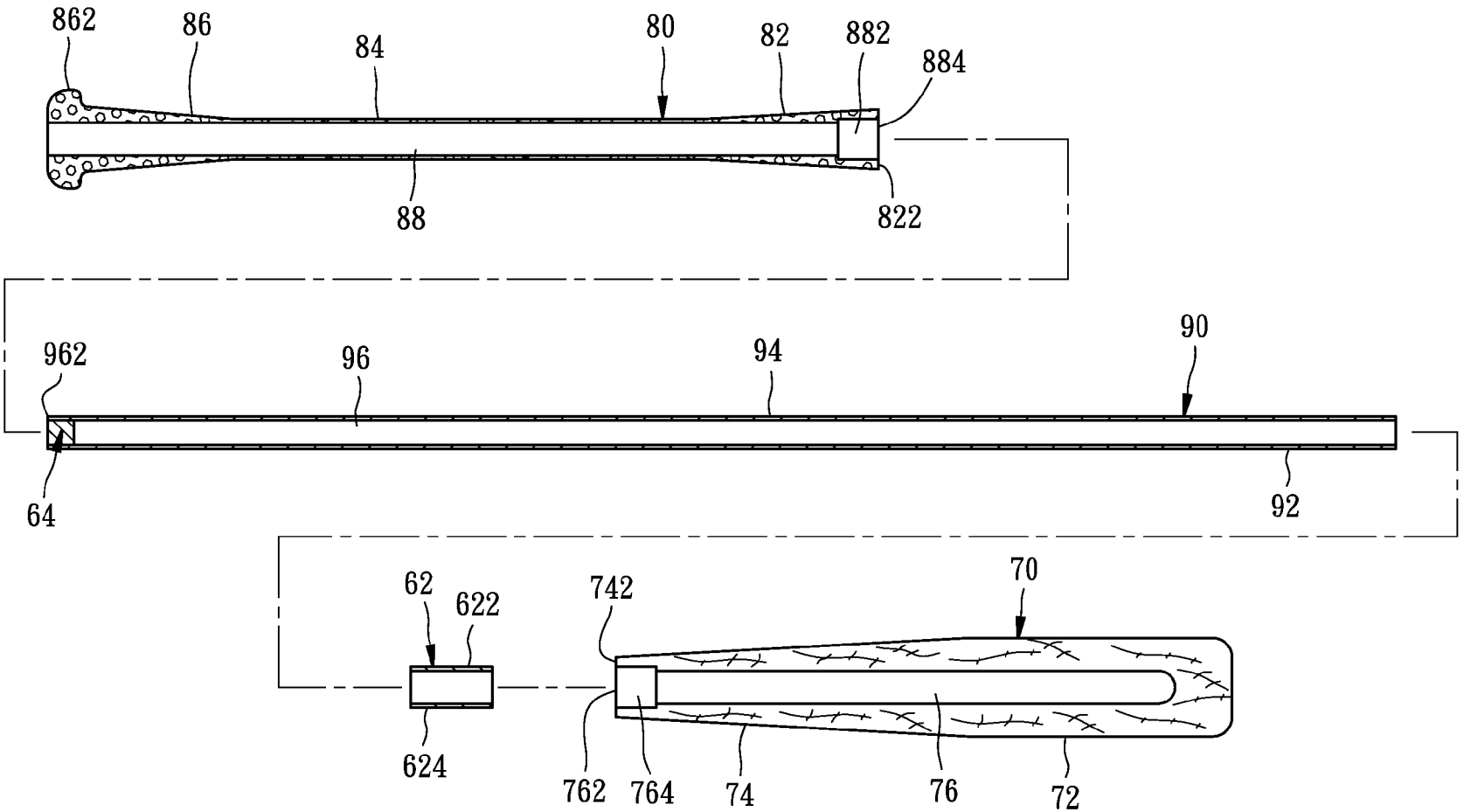
FIG. 6 is an exploded perspective view of the baseball bat depicted in FIG. 4.

Referring lastly to FIGS. 4, 5 and 6, a baseball bat 60 of the third embodiment in accordance with the present invention includes a barrel body 70, a grip body 80 and an elongate shaft 90.

In this embodiment, barrel body 70 is made of wooden materials. Barrel body 70 has a striking section 72 for striking, impacting, or hitting, and a tapered mid-section 74. Barrel body 70 further has a front axial bore 76 with an entrance 762 formed on rear end 742 of tapered mid-section 74 and a first enlarged part 764 adjacent to entrance 762.

Grip body 80, in this embodiment, is made of polyurethane. It includes a front section 82, a mid section 84 and a rear section 86 with a knob 862. Grip body 80 further has a rear axial bore 88 with a second enlarged part 882 adjacent to head end 822 of front section 82.

Elongate shaft 90 is tube-shaped and made of fiber-reinforced composite material. Shaft 90 includes a front portion 92, an intermediate portion 94 and a rear portion 96.

In this embodiment, bat 60 further includes a sleeve 62 having a first part 622 and a second part 624. In combination, first part 622 of sleeve 62 is intimately received in first enlarged part 764 of front axial bore 76 of barrel body 70. Second part 624 is intimately received in second enlarged part 882 of rear axial bore 88 of grip body 80. Front portion 92 of shaft 90 inserts and extends into front axial bore 76 of barrel body 70 from entrance 762 in such a way that barrel body 70 intimately surrounds front portion 92 of shaft 90. Intermediate portion 94 of shaft 90 as well as rear portion 96 of shaft 90 inserts and extends into rear axial bore 88 of grip body 80 from entrance 884 in such way that grip body 80 intimately surrounds intermediate portion 94 and rear portion 96 of shaft 90 and sleeve 62 is put intimately around intermediate portion 94 of shaft 90. A barrel end plug 64 is plugged into distal end 962 of rear portion 96 of shaft 90.

As described herein, we can find that for having a reinforcing member disposed on an area from where the flexed portion of the bat starts, the bat will have a smaller flexed margin at the striking moment when comparing with the prior art bat. Thus, the drawbacks of the bat disclosed in U.S. Pat. No. 6,929,573 are eliminated.

What is claimed is:

1. A bat constructed for striking a ball, the bat comprising:

an elongate shaft made of metal or fiber-reinforced composite material which includes a front portion, an intermediate portion and a rear portion;

a reinforcing member made of metal or fiber-reinforced composite material which is disposed on a distal end of said front portion of said shaft;

a barrel body made of wooden materials which includes a striking section for striking, impacting, or hitting and a mid-section, said barrel body intimately surrounding said front portion of said shaft; and a grip body made of resilient materials with good shock absorbing property which includes a front end and a terminal end, said grip body intimately surrounded said rear portion of said shaft, wherein said grip body extends from said front end thereof to a rear end of said mid section of said barrel body such that said intermediate portion of said shaft is intimately surrounded by said grip body, and wherein said barrel body further has a front axial bore with a first entrance formed on a distal end of said mid-section of said barrel body and a first enlarged part formed adjacent to said first entrance thereof; said grip body further has a rear axial bore with a second entrance formed on a head end of said front end of said grip body and a second enlarged part formed adjacent to said second entrance thereof; and said reinforcing member has a first part and a second part; said front portion of said shaft inserts and extends into said front axial bore of said barrel body from said first entrance thereof in such a way that said first part of said reinforcing member is intimately received in said first enlarged part of said front axial bore of said barrel body, said intermediate portion and said rear portion of said shaft insert and extend into said rear axial bore of said grip body from said second entrance thereof in such a way that said second part of said reinforcing member is intimately received in said second enlarged part of said rear axial bore of said grip body.

2. The bat as claimed in claim 1, wherein said reinforcing member comprises a sleeve which is tightly put around said distal end of said front portion of said shaft.

3. The bat as claimed in claim 1, wherein said reinforcing member is disposed in an area of the distal end of the front portion of the shaft from where a flexed portion of the bat starts.

* * * * *